US005174824A

United States Patent [19]

Salancy et al.

[11] Patent Number: 5,174,824

[45] Date of Patent: Dec. 29, 1992

[54] TAPE TAKE-AWAY AND MOISTENING SYSTEM

[75] Inventors: William A. Salancy; Steven A. Supron, both of Norwalk; Bret K. Taylor, Shelton; Leo L. Wologodzew, Huntington, all of Conn.

[73] Assignee: Pitney Bowes Inc., Stamford, Conn.

[21] Appl. No.: 606,978

[22] Filed: Oct. 31, 1990

[51] Int. Cl.[5] ..... B05C 1/00

[52] U.S. Cl. ..... 118/253; 118/209; 118/239; 118/264; 118/256

[58] Field of Search ..... 118/200, 209, 239, 244, 118/256, 258, 264, 246, 500; 226/179, 90; 156/35, 33, 38, 29, 41, 517, 521

[56] References Cited

U.S. PATENT DOCUMENTS

| | | | |
|---|---|---|---|
| 3,238,081 | 3/1966 | Lopez | 156/521 |
| 3,750,924 | 8/1973 | Pepper | 226/190 |
| 4,387,000 | 6/1983 | Tancredi | 156/555 |
| 4,482,148 | 11/1984 | Stewart, Jr. | 226/179 |
| 4,670,081 | 6/1987 | Takahashi et al. | 156/DIG. 41 |
| 4,917,283 | 4/1990 | Weatherhead et al. | 226/190 |
| 5,007,370 | 4/1991 | Dannatt | 118/246 |
| 5,057,181 | 10/1991 | Mundus | 156/517 |

*Primary Examiner*—W. Gary Jones
*Assistant Examiner*—Brenda Lamb
*Attorney, Agent, or Firm*—Charles G. Parks, Jr.; Melvin J. Scolnick

[57] ABSTRACT

The improved tape advancing system includes a conveyor having a moving surface, a motor having an output shaft, means coupled to said motor for driving said moving surface. A frame is locate opposite said moving surface and includes a plurality of wheel assemblies rotatively supported by said frame for assuring positive communication between the tape shaft carrying a first and second wheel fixably mounted to respective ends of the shaft and are spaced apart, a distance such that said wheels will contact an edge portion of the tape which has not been printed upon by an associated postage meter.

4 Claims, 4 Drawing Sheets

TAPE TAKE-AWAY AND MOISTENING SYSTEM

RELATED APPLICATION

This application is related to U.S. patent application Ser. No. 527,972 filed May 24, 1990 and entitled TAPE TAKE-AWAY AND MOISTENING SYSTEM.

BACKGROUND OF THE INVENTION

The invention disclosed herein relates to tape handling apparatus, particularly a tape advancing system which selectively advances tape in a plurality of directions and to components thereof, and more particularly to a system and components thereof for advancing tape either to a moistener device or to bypass the moistener device. The invention relates further to a moistener device for moistening the tape to activate glue thereon.

It is desirable for a mailing machine to process different sizes and types of mail quickly and efficiently. It is also desirable for a mailing machine to imprint postage and like indicia either directly on the mail piece or on a tape strip which is thereafter affixed to a mail piece that may be too large or too irregularly shaped to imprint postage indicia directly thereon. Moreover, for high-speed operation, it is desirable that the mailing machine selectively imprint either the mail piece or a tape without shutting down the machine to changeover from imprinting mail pieces to tape and vice versa. It is also desirable for a mailing machine to imprint different types of tape, for example, a tape having a water-activate adhesive or a tape having pressure-sensitive adhesive.

SUMMARY OF THE INVENTION

It is an objective of the present invention to present an improved take-away and moistening system for advancing flat material, such as, tape, which selectively advances the material in a plurality of directions and economizes in parts used to advance the material and selectively change its direction. The invention also provides an improved moistening device to which a tape is selectively advanced by, for example, the material advancing system.

In a specific embodiment, an advancing system is provided for selectively advancing generally flat materials, such as, tape, in first and second directions, comprising a conveyor including an endless moving surface which advances material fed onto the moving surface to a conveyor exit. The advancing system also includes an upper frame. The frame rotatably supports a plurality of wheel assemblies cooperatively aligned above the moving surface. The wheel assemblies are biased against a tape being carried by the moving surface to prevent slippage. A motor having a shaft which the motor rotates in opposite directions; means coupling the shaft to drive the moving surface in an exit direction. A diverter coupled to a two position solenoid is disposed at the exit of the conveyor for selectively directing the material in the first or second directions.

A moistener device includes a reservoir and a moistening brush partly submerged in the reservoir. The moistening brush is positioned to contact the transported tape at the exit when the diverter is in the first position only.

BRIEF DESCRIPTION OF THE DRAWINGS

The invention is illustrated by way of example and not limitation in the figures of the accompanying drawings in which like references denote the same elements, and in which.

DETAILED DESCRIPTION OF THE PREFERRED EMBODIMENT

In a mail processing system such as that described in U.S. Pat. No. 4,935,078, entitled HIGH THROUGHPUT MAILING MACHINE TIMING, provision is made for the processing of tape strip for application to mail pieces too large to be processed through the mailing machine. As part of the tape process apparatus, the mailing machine includes a take-away and moistening system which receives tape section from the printing station and transports the tape section to a machine exit and can optionally moisten the tape section prior to exit. A detailed description of a particularly suited tape take-away and moistening system is described in U.S. patent application Ser. No. 527,972 filed May 24, 1990, herein incorporated by reference.

Figure 1:
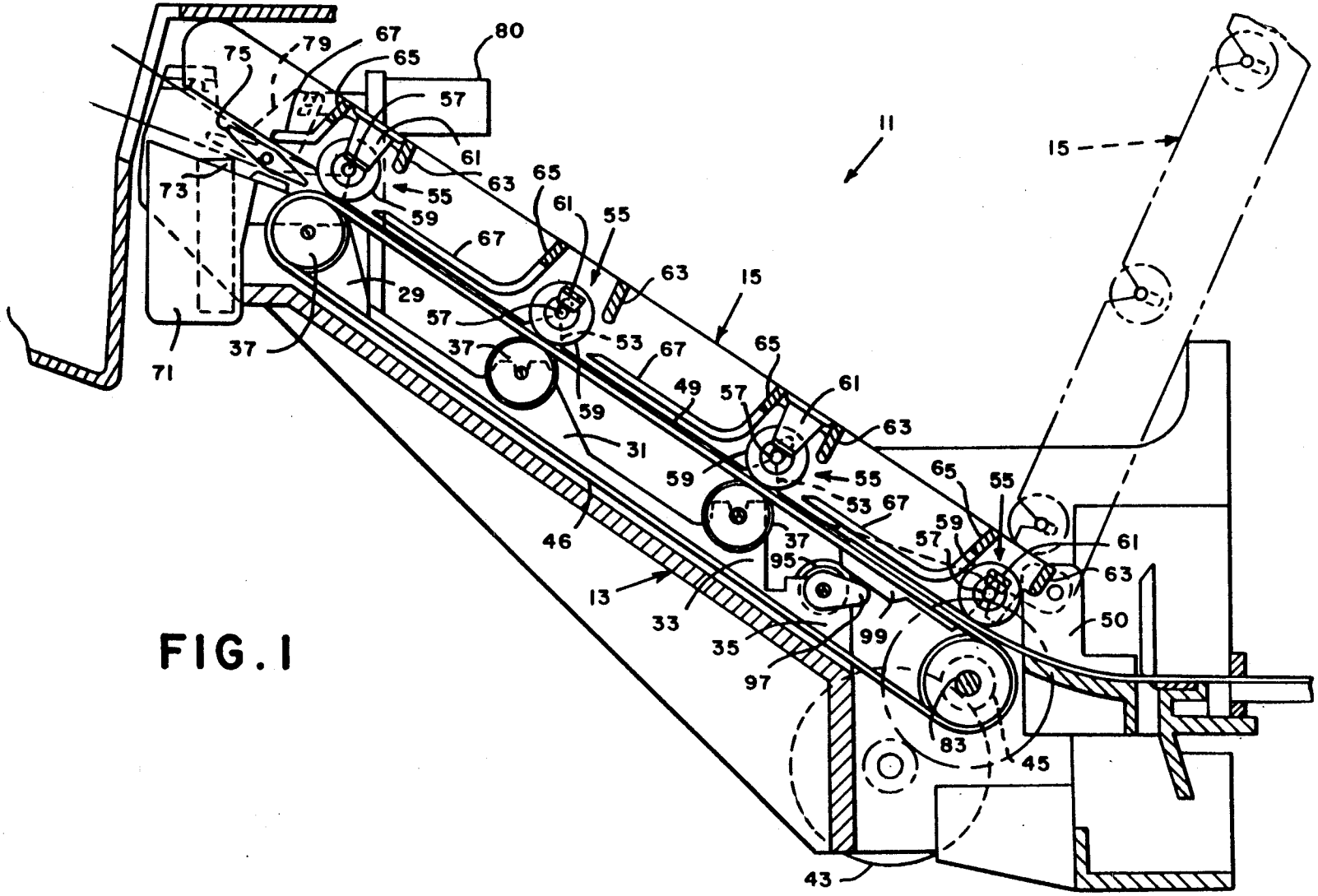
FIG. 1 is a side sectional view of a tape take-away and moistening system in accordance with the present invention.

Referring to FIG. 1, the take-away and moistening system, generally indicated as 11, includes a lower frame 13 supported within the mailing machine (not shown). The frame 13 includes laterally positioned spaced apart flanges 17 and 19 (FIG. 2) as a formed part of the frame 13. Flange 17 carries a plurality of formed mounting hubs 21, 23, 25, and 27. In like manner, flange 19 includes mounting hubs 29, 31, 33, and 35. Rollers 37 having and shafts 39 are rotatably mounted between aligned mounting hubs 21–29, 23–31, 25–33, 27–35.

Figure 2:
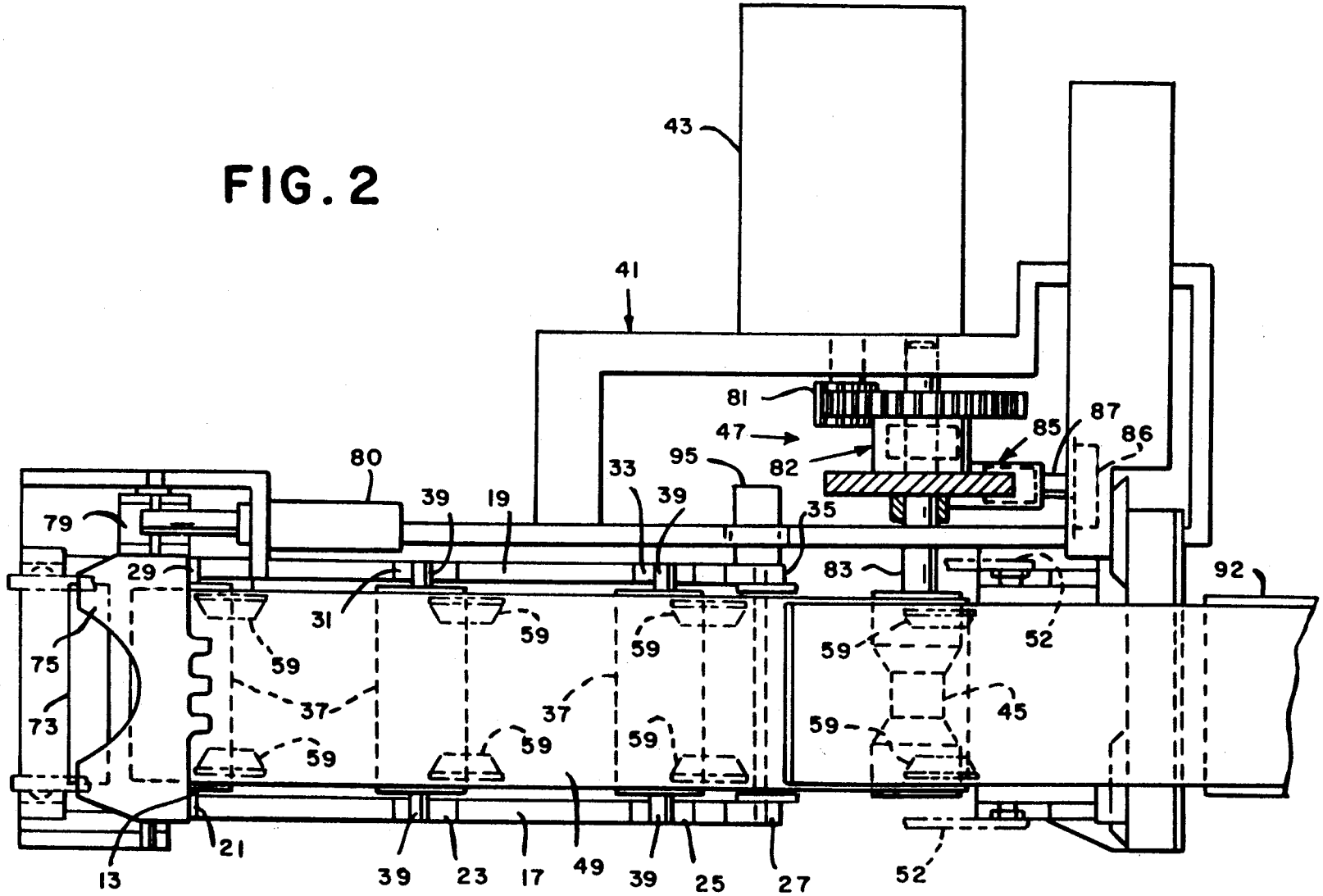
FIG. 2 is a section elevated view of the tape take-away and moistening system.
Figure 3A:
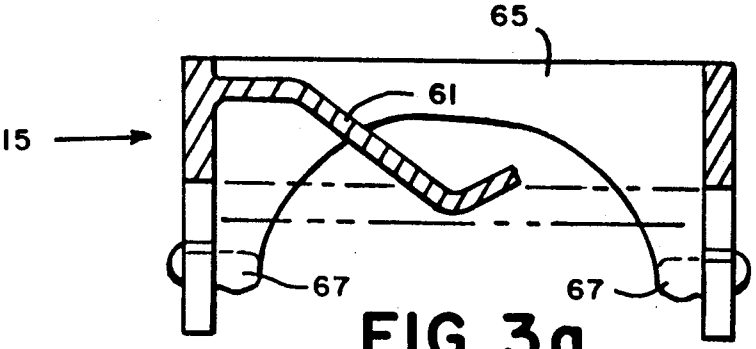
FIG. 3*a* is a sectional view of the take-away and moistening system taken along line 3*a*—3*a*.
Figure 3:
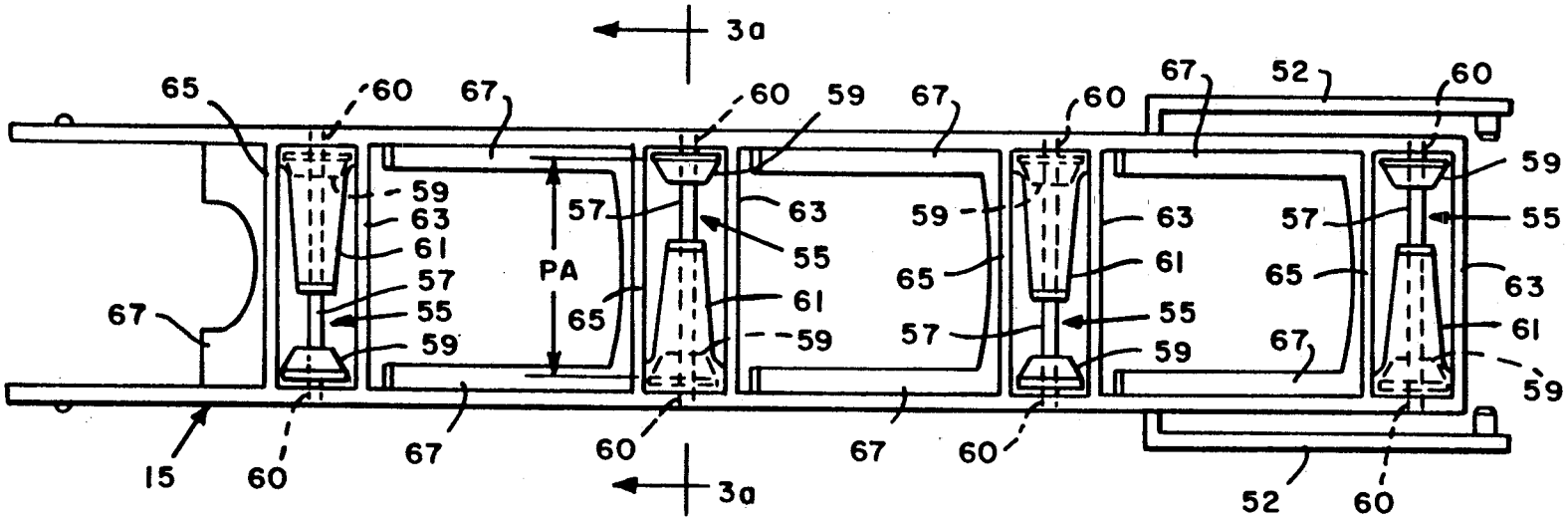
FIG. 3 is an elevated view of a guide frame portion of the tape take-away and moistening system.

Referring also to FIG. 2, a second support frame 41 extending from frame 13 is formed within the mailing machine. A motor 43 is mounted to the second support frame 41 for driving a drive pulley 45 rotatably supported by the second support frame 41 through a gear train 47. An endless belt 46 is extended around the rollers 37 and 45 to form a continuous transport surface 49.

Referring to FIGS. 1, 2, 3 and 3*a*, frame 15 is pivotally mounted to support post 50 in the mailing machine by frame pivot arms 52 and a hinge support means which is disposed adjacent the endless belt for pivotally supporting the frame. The frame 15 includes a plurality of aligned snap recesses 53 for rotatively supporting respective wheel assemblies 55. Each wheel assembly 55 is comprised of a center shaft 57 having at its ends limited contact wheels 59 and mounted stub shafts 60. Preferably, the spacing between the contact surface of wheels 59 represents a non-contact area noted as PA which represents the printing area of a tape transported along the endless belt 46. That is, it is preferred that the wheels 59 not come into contact with the print area of the tape. However, in the presence of space limitation where it is required that the wheels 59 contact the print area, the contact surface of the wheels may be star pointed to minimize any potential degrading of the print of quality of tape imprinted material. Formed to the frame 15 are biasing leaves 61 such that when the wheel assemblies 55 are snapped into aligned recesses 53, the biasing leaves 61 are deflected to provide a reactionary downward force such that positive contact between the wheels 59 and any transported tape is maintained. The frame 15 also includes stiffener members 63 and stiffener members 65. Stiffener members 65 formed thereon guide tabs 67 which are projected toward the exit to inhibit any transported tape from becoming jammed or crinkled within the transport system.

The lower frame 13 includes a reservoir 71 mounted to the lower frame 13 having a moistening brush 73 partly submerged therein to receive fluid from the reservoir 71 and apply moistening fluid to any tape which is directed through the transport system exit thereto. A two-position deflector 75 is pivotally mounted between support members of the mailing machine (not shown) and includes a deflector positioning arm 79 coupled to a solenoid 80. The deflector 75 is aligned at and in a first position such that tapes passing from the transport exit is deflected downwardly to contact the moistening brush 73 and thereby moistening. In the second position, the deflector 75 is positioned such that tape exiting from the transport exit is deflected away from the moistening brush 73. It should be appreciated that the deflector 75 will allow the processing of tape which requires moistening or which is self-adhesive.

Figure 4:
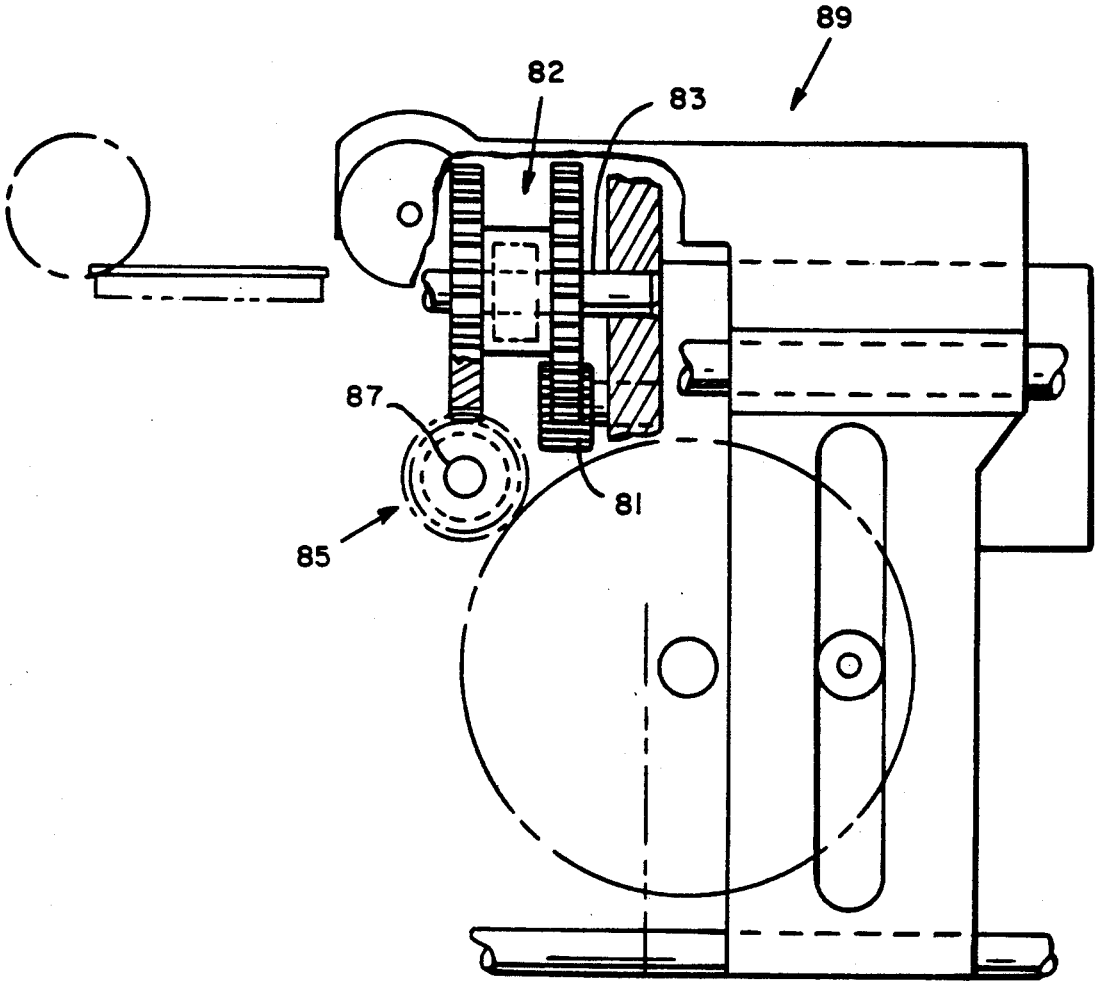
FIG. 4 is a side sectional view of a cooperative tape cutter assembly.

In operation, the motor 43 includes a motor output gear 81 which is in constant mesh with a double-gear clutch assembly 82 rotatably mounted around shaft 83. A second gear shaft assembly 85 is carried by a shaft 87 pivotally mounted within the second support frame 41 having a cutter drive gear 86 (FIG. 2) at one end of the shaft 87. Referring in addition to FIG. 4, cutter drive gear assembly 89 is comprised of a cutter blade mounted to a frame which is slidable along rails by a gear and pin combination wherein the pin slides along a slot in the support frame 13.

When the motor 43 drives in a first direction, the double-gear assembly clutch 82 is clutched to the shaft 83 to drive the drive pulley 45 during which time the second gear shaft assembly 85 is disengaged. As tape is advanced within the take-away and moistening system by drive pulley 45, at some point corresponding to the prescribed tape length, the motor 43 is caused to change direction, resulting in declutching of the double gear clutch assembly 82 from the shaft 83 and thereby engaging second gear clutch assembly 85. Engagement of the second gear shaft assembly 85 causes the tape cutter assembly via cutter drive gear 86 to be activated to cut the tape received within the transport. Redirecting the motor 43 in its original direction disengages the second gear shaft assembly 85 and causes the take-away and moistening system 11 to feed the tape to the transport exit area. The tape then comes into contact with the deflector 75. As afore noted, the deflector 75 when selectively positioned in one position by the solenoid 80 causes the tape to traverse along the moistening brush 73 or to deflect away from the moistening brush 73 and out of the transport exit. It is noted that any suitable motor controller can be used to selectively activate motor 43 and solenoid 80 as described.

It is noted that for additional assurance that the tape does not jam when it is received in the entrance of the tape transport, a rotary solenoid 95 is mounted to the frame assembly 13 such that activation of the rotary solenoid 95, by any suitable means, causes a finger 97 to abut a bumper 99 on the frame assembly 15. In response, the forward entrance of the frame assembly is elevated relative to the incoming tape. Once the tape has then been received within the frame assembly, the rotary solenoid can be deactivated causing the forward frames 15 to reposition and compress on the tape.

Certain changes and modifications of the embodiment of the invention herein disclosed will be readily apparent to those of skill in the art. Moreover, a use of the invention other than a mailing apparatus will also be readily apparent to those of skill in the art. It is the Applicants' invention to cover by the claims all such uses and all those changes and modifications which could be made to the embodiment of the invention herein chosen for the purpose of disclosure which do not depart from the spirit and scope of the claims.

What is claimed is:

1. An improved tape advancing system in combination with a postage mailing machine, said tape advancing system having a conveyor having a moving belt surface, supported by a support arrangement and under the influence of a motor for driving said moving belt surface in an exit feed direction after receiving a tape strip in a tape entrance, wherein said improvement comprises:

a frame pivotally mounted in said postage mailing machine at the entrance and located opposite said moving belt surface such that said frame may be displaced from said moving belt surface at said entrance or pivotally displaced about said entrance, said frame having a plurality of wheel assemblies rotatively supported by said frame and spaced apart at a distance equal to the length of the shortest tape segment to be transported therein such that said shortest tape segment remains in physical contact with at least one of said respective wheel assemblies until ejected from said tape advancing system, said frame being cooperatively aligned opposite said moving belt surface, each of said wheel assemblies including a shaft carrying a first and second wheel fixably mounted to respective ends of said shaft, said wheels being spaced apart to restrict respective wheel contact to a respective edge portion of said tape, said frame having biasing means for biasing said respective wheel assemblies against said wheel contacting tape portion into said moving belt surface, said belt support arrangement further having a plurality of rollers for supporting and moving said moving belt surface, said plurality of rollers aligned opposite to respective one of said wheels of said wheel assemblies with a portion of said belt therebetween; and a means for displacing said frame at said entrance to receive a leading portion of said tape upon entry to said tape advancing system and then to return said frame to its original position.

2. An improved tape advancing system as claimed in claim 1, wherein the means for displacing said frame at said entrance is a rotary solenoid which causes a finger fixably mounted to an end of said rotary solenoid to abut a bumper on said frame when said frame is receiving said leading portion of said tape.

3. An improved tape advancing system as claimed in claim 1, wherein said frame is pivotally displaceable between a first and second position for allowing access to said tape advancing on said moving belt surface in said first position and for biasing said tape against said moving belt surface in said second position;

a hinge support means for pivotally supporting said frame; and said hinge support means disposed adjacent said moving belt surface where said moving belt surface begins conveying said tape.

4. An improved tape advancing system as claimed in claim 1 or 3 further comprising a moistening means for applying moistening fluid to the underside of said tape upon exit of said tape from said moving belt surface, a means for retaining said fluid, a two position diverter for directing said tape to said moistening means in a first diverter position and away from said moistening means in a second diverter position, and means for positioning said diverter in said first or second diverter position.

* * * * *